United States Patent [19]

Morgenstein

[11] 3,955,294

[45] May 11, 1976

[54] ELEVATOR APPARATUS FOR TOWED DEEP-SEA PARTICLE HARVESTER

[75] Inventor: Maurice E. Morgenstein, Kaneohe, Hawaii

[73] Assignee: Hawaii Marine Research, Inc., Kaneohe, Hawaii

[22] Filed: Feb. 10, 1975

[21] Appl. No.: 548,483

[52] U.S. Cl. ..... 37/69; 37/DIG. 8; 37/71; 198/109; 198/116; 299/9

[51] Int. Cl.[2] ..... E02F 3/14

[58] Field of Search ..... 37/55, 57, 60, 69, 71, 37/195, DIG. 8; 299/8–10, 18; 115/7, 8; 198/109, 116, 137

[56] References Cited

UNITED STATES PATENTS

| | | | |
|---|---|---|---|
| 82,376 | 9/1868 | Boschke | 37/69 |
| 610,763 | 9/1898 | Kibling | 37/69 |
| 991,333 | 5/1911 | Lybeck | 37/57 X |
| 1,190,224 | 7/1916 | Drouard | 37/57 |
| 1,705,428 | 3/1929 | Twiford | 37/57 X |
| 2,217,412 | 10/1940 | Jackson et al. | 37/55 |
| 2,978,819 | 4/1961 | Paulson | 37/57 |
| 3,238,708 | 3/1966 | Zickefoose | 37/55 X |
| 3,540,226 | 11/1970 | Sherrod | 115/7 X |
| 3,672,079 | 6/1972 | Matsuda et al. | 37/69 |

FOREIGN PATENTS OR APPLICATIONS

| | | | |
|---|---|---|---|
| 692,998 | 8/1964 | Canada | 37/58 |
| 780,571 | 4/1935 | France | 299/9 |

*Primary Examiner*—E. H. Eickholt
*Attorney, Agent, or Firm*—Townsend and Townsend

[57] ABSTRACT

An elevator apparatus for emptying a towed deep-sea particle harvesting sled is disclosed. The sled is towed over the bottom surface of a deep-sea ocean bed by a strip. The strip is connected at its lower end to the sled, at its upper end to the vessel, and is under tension between the sled and the vessel as the sled is towed over the ocean floor. The strip includes a first railway for passing downwardly sequentially conveyed buckets on an endless belt from the surface vessel to the sled, and a second railway for passing upwardly sequentially conveyed buckets from the sled to the vessel. At the sled, the buckets are reversed on a wheel. The buckets pass through an area wherein collected particles are accumulated with the result that the buckets capture the particles and elevate them along the strip to the surface. At the surface on the vessel a similar wheel reverses the path of the conveyed buckets, as well as emptying the buckets into a surface collection area which is preferably on the vessel. The strip includes spaced apart cable members which are clamped between discrete sections of neutrally buoyant track. These sections of neutrally buoyant track provide an enclosed path for a cable drawing the buckets. This enclosed path is penetrated by a grip fastening the buckets to the moving endless belt. Thus, the cable not only moves the individual buckets, but additionally assures that the buckets are held to their railways on the towing strip.

12 Claims, 7 Drawing Figures

ELEVATOR APPARATUS FOR TOWED DEEP-SEA PARTICLE HARVESTER

This invention relates to submarine elevators, and more particularly to a submarine elevator for emptying collected mineral particles from the ocean floor to a vessel on the surface.

SUMMARY OF THE PRIOR ART

Heretofore, submarine elevators for elevating particles collected from the ocean floor have consisted of two types. A first type of elevator consists of a long endless cable having a series of buckets independently attached to it. These buckets are dragged over the ocean floor and elevated along a first segment of the endless cable to the surface, emptied at the surface and reconveyed to the ocean floor along a second segment of the endless cable.

Unfortunately, no provision is made to keep either the elevating cable segment or the descending cable segment separate, one from another. As a result, provision must be made to handle the elevating segments of the endless cable at a spaced apart surface location from the descending segments of the endless cable. Nevertheless, entanglement frequently results. Damage to the cable and to the buckets frequently occurs. An example of such an apparatus can be seen in Masuda et al. U.S. Pat. No. 3,672,079.

A second common type of elevator consists of a pipe or conduit extending from a collection vehicle on the ocean floor to the surface. Typically, the pipe or conduit includes a rapidly rising column of water which is either produced by a conventional hydraulic pump or, alternatively, by an air jet having an inlet at the bottom of the pipe. Such elevators inevitably block on any occlusion of the rising column of water. Typically, all the entrained harvested particles in the rising column immediately settle when water flow ceases. Plugging and even bursting of the pipe or conduit inevitably results.

Moreover, such conduits are unsuitable for towing. Additionally, such elevator mechanisms cannot accomodate large changes in vertical distance between the surface vessel and the collecting vehicle on the ocean floor. Thus, where such elevation changes are produced either at the collection vehicle by changes in elevation of the ocean floor or at the surface vessel by the ambient seas, they are not easily accommodated.

An example of such a pipe or conduit elevator apparatus is shown in Steele et al. U.S. Pat. No. 3,504,945.

SUMMARY OF THE INVENTION

An elevator apparatus for emptying a towed deep-sea particle harvesting sled is disclosed. The sled is towed over the bottom surface of a deep-sea ocean bed by a strip. The strip is connected at its lower end to the sled, at its upper end to the vessel, and is under tension between the sled and the vessel as the sled is towed over the ocean floor. The strip includes a first railway for passing downwardly sequentially conveyed buckets on an endless belt from the surface vessel to the sled, and a second railway for passing upwardly sequentially conveyed buckets from the sled to the vessel. At the sled, the buckets are reversed on a wheel. The buckets pass through an area wherein collected particles are accumulated with the result that the buckets capture the particles and elevate them along the strip to the surface. At the surface on the vessel a similar wheel reverses the path of the conveyed buckets, as well as emptying the buckets into a surface collection area which is preferably on the vessel. The strip includes spaced apart cable members which are clamped between discrete sections of neutrally buoyant track. These sections of neutrally buoyant track provide an enclosed path for a cable drawing the buckets. This enclosed path is penetrated by a grip fastening the buckets to the moving endless belt. Thus, the cable not only moves the individual buckets, but additionally assures that the buckets are held to their railways on the towing strip.

OBJECTS AND ADVANTAGES OF THE INVENTION

An object of this invention is to provide a deep-sea elevator with discrete paths to and from a collector sled on the ocean bottom. According to this aspect of the invention, a strip is kept under tension by towing a sled from a surface vessel. Paired and separate tracks, preferably on opposite sides of the strip, are provided for descending and ascending collector buckets. An endless towing cable is threaded over the tracks and provides power to move the attached collector buckets over the tracks on the towing strip.

An advantage of the elevator mechanism is that entanglement of ascending and descending collector buckets and their cables is avoided.

A further advantage of this aspect of the invention is that the track, under tension, provides the necessary structural rigidity to support the buckets along a confined path. No rigid frame mechanisms extending from the surface to the sea floor are required.

Yet another advantage of the invention is that the towing strip can be constructed with neutral buoyancy. It is not required that the surface vessel support the weight of the strip to the ocean floor, nor that the strip itself be of strength to support its own weight. All that is required is that the surface vessel and towing strip have enough power and strength to pull the sled and overcome the inertial forces of the strip and towed sled as well as the hydraulic forces acting on the towed apparatus.

Yet a further advantage of this invention is that the speed of the elevator or sled can be varied to conform to the density of the particles being harvested from the ocean floor. For example, where a particularly dense deposit area is encountered, the speed of towing can be reduced while the speed of the elevator can be increased to assure efficient and complete harvest.

Yet another advantage of the towing strip of this invention is that a shielded path for communication and power cables between the surface vessel and the towed sled is provided. Power to motors and lights as well as communication cables to monitoring television apparatus can be provided to the elevator system without substantial exposure to cable rupture or breakage or the like.

A further object of this invention is to disclose an elevator apparatus which can be placed into and retrieved from the sea. According to this aspect, the sled on the sea bottom is towed by paired cables which extend the full length between the sled at the bottom of the sea and the towing vessel. These paired cables are captured in spaced apart grooves on discrete sections of track. The sections of track confront each other at their rear surface to capture the paired cables in spaced apart relation. The track sections define on their outwardly exposed surface the railway necessary for the conveyance of the buckets to and from the ocean floor.

An advantage of the disclosed track is that it can be added to or taken away from, dependent upon the length of run to the ocean floor.

A further object of this invention is to set forth a system for fastening the hoppers to their respective railways on the towing track. According to this aspect of the invention, the endless cable is confined to and captured within a groove defined on each of the tracks. The buckets are fastened to the endless cable by means of a grip which penetrates the groove to the captured cable. When the cable is moved, the buckets also move, but are held by the captured cable to the tracks on the towing strip.

Other objects, features and advantages of this invention will become more apparent after referring to the following specification and attached drawings in which:

FIG. 1 is a side elevation section of a towing vessel on the surface pulling the ocean bottom mining apparatus or sled of this invention along a sea bottom with the elevator apparatus of this invention disposed there between;

Figure 1:
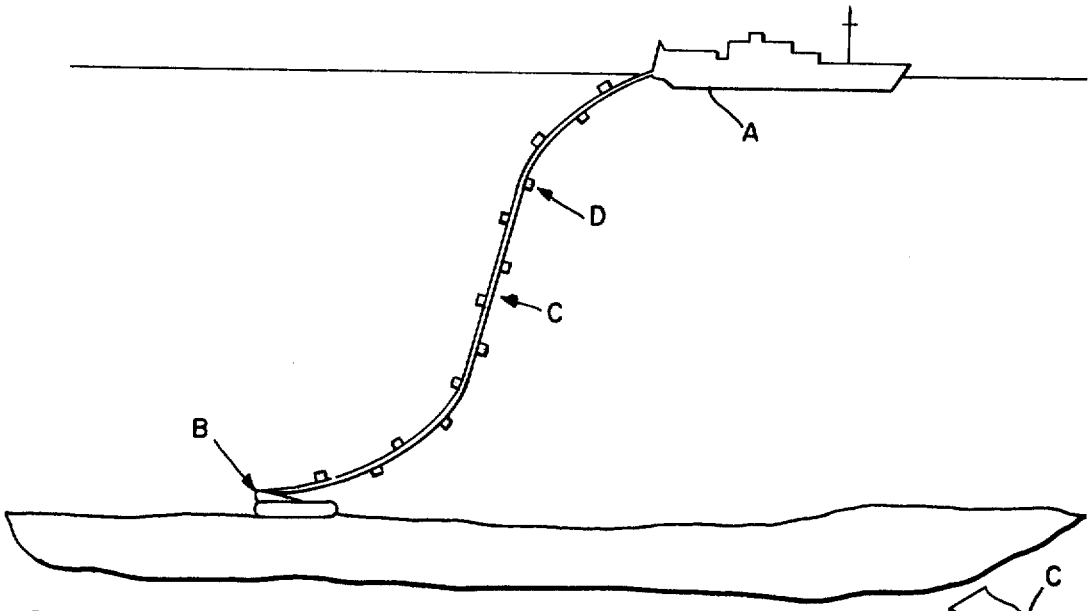

Referring to FIG. 1, towing vessel A is shown towing sled B with flexible strip C. Strip C has conveyed thereon a series of buckets D which serve to empty particles harvested at the sled, elevate them along strip C and deposit them interior of vessel A.

Figure 2:
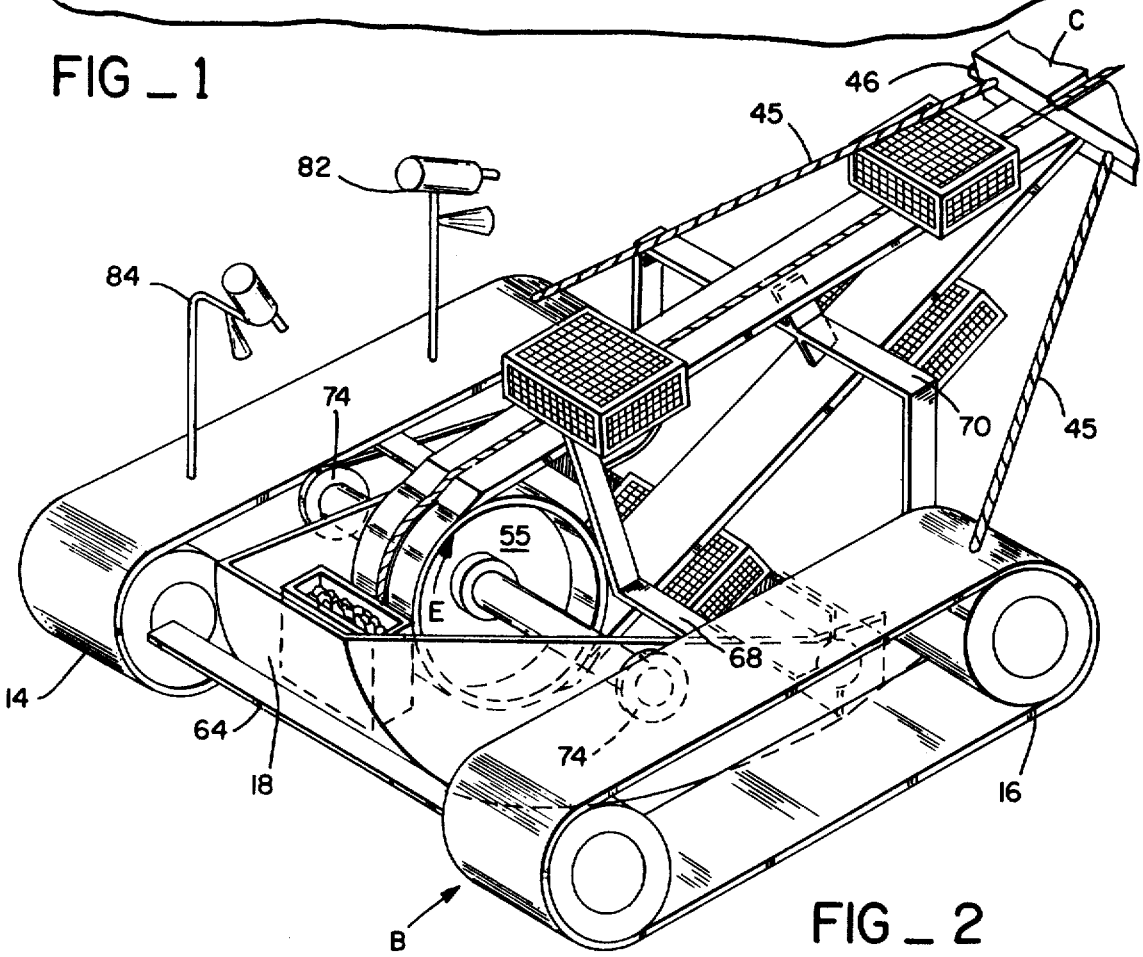
FIG. 2 is a perspective view of a mineral harvesting apparatus or sled of this invention showing the elevator mechanism of this invention attached thereto for moving accumulated particles to the surface towing vessel.
Figure 3:
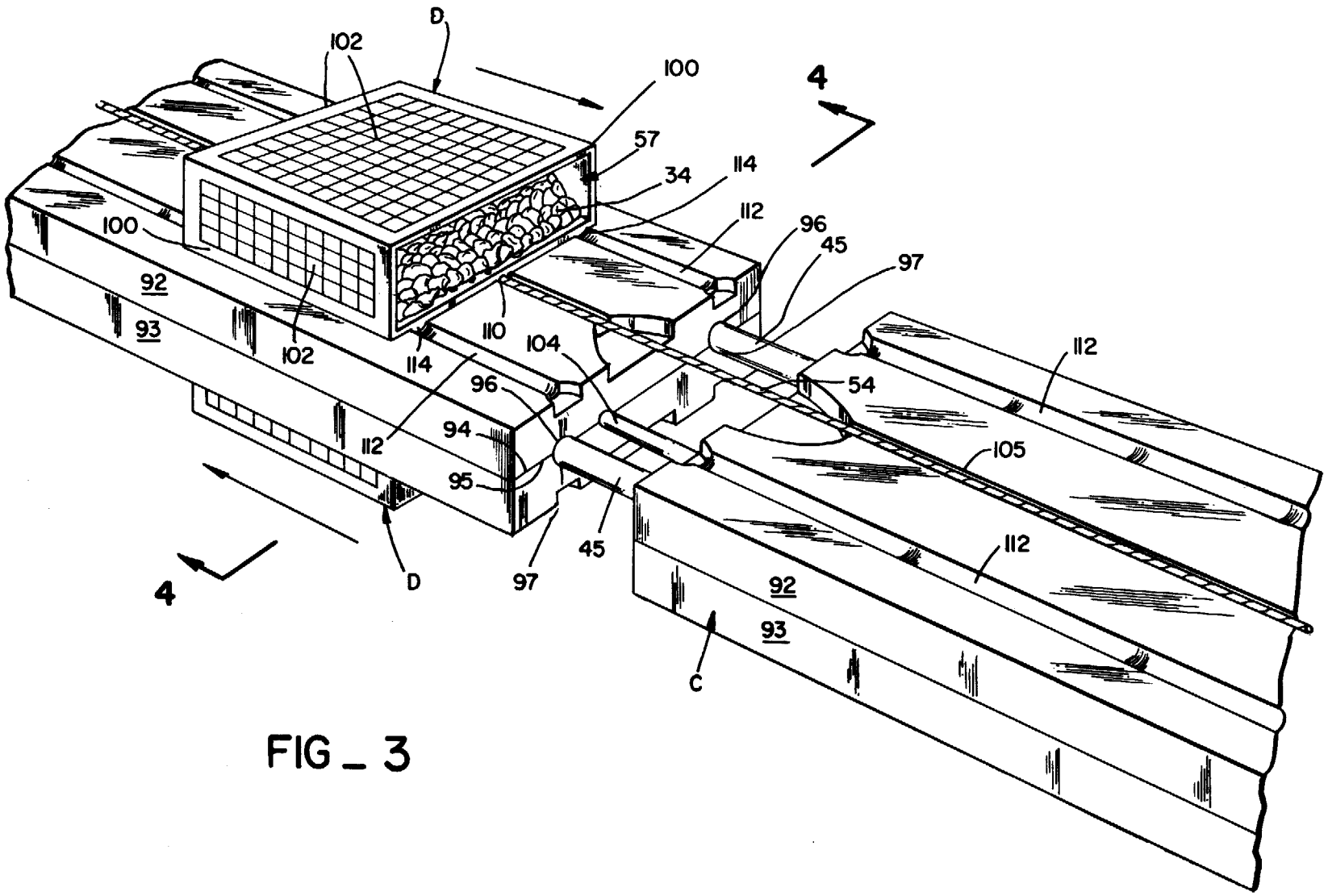
FIG. 3 is a perspective view of the towing strip and conveyed buckets utilized with the towing appartus of this invention.
Figure 4:
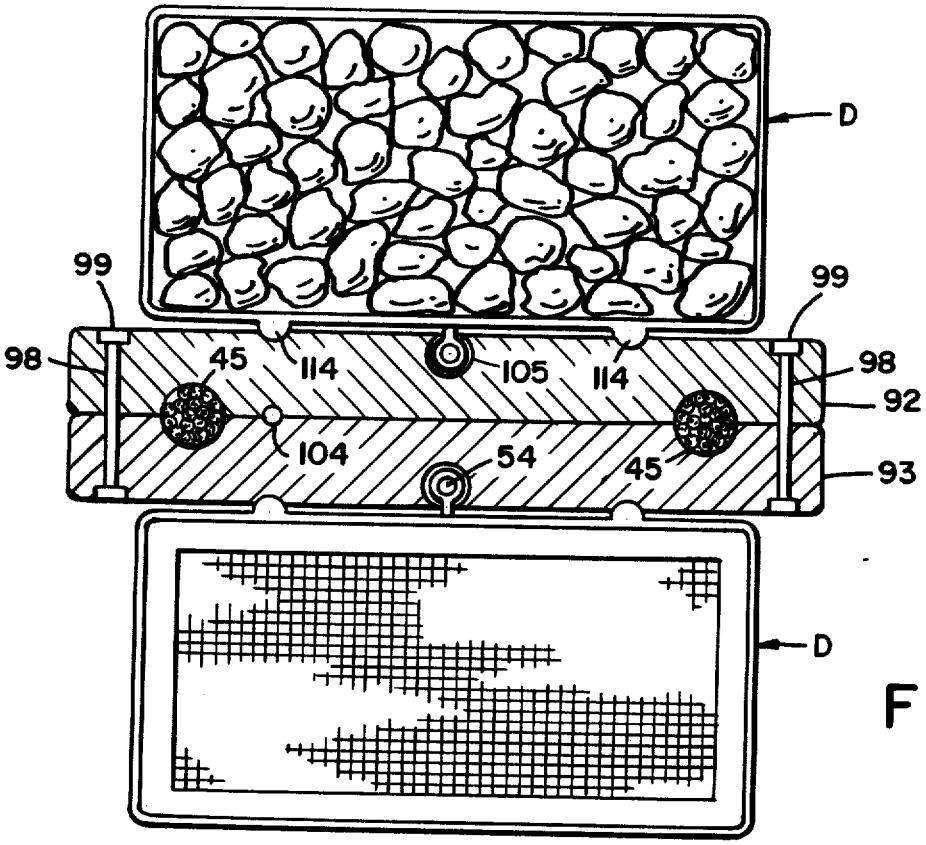
FIG. 4 is a cross sectional view of the towing strip and conveyed buckets taken along lines 4—4 of FIG. 3.

In order to understand the apparatus here shown, it will be convenient first to set forth and discuss the sled with reference to FIGS. 2–4. Thereafter, the conveying strip C and the series of endless buckets D will be set forth with reference to FIG. 5. Finally, the handling of strip C and buckets D on vessel A will be set forth with respect to FIG. 6.

Referring to FIG. 2, towing sled B consists of paired runners 14, 16 and intermediate particle gathering trough 18. Particle gathering trough 18 includes an arcuate bottom wall 20 and two converging sidewalls 22, 23. As will hereinafter be set forth fully and in more detail, particles harvested pass interiorly of trough 18 along the arcuate bottom and end wall 20. Simultaneously, particles are converged by the sidewalls 22, 23 into the path of elevator mechanism E.

Preferably, each of the tracks 14, 16 of sled B is approximately 2 meters wide. The open front leading edge 26 of the trough between the tracks is approximately 6 meters wide. The entire sled is considerably heavier than the density of water so that during towing it will pass in a mineral collecting contact with the ocean bottom.

It should be noted that both the width of tracks 14, 16 as well as the width of trough 18 will be a design function of the density of the ocean floor being mined.

At leading edge 26, the sled is provided with a scarifyer (not shown). This scarifyer penetrates with individual spaced apart tines into the layer of mineral particles and sediment to classify out the mineral particles. Second, the scarifyer is mounted well aft of the leading edge of the sled tracks 14, 16 so that the track can bear down on the ooze or sediment of the ocean floor and prevent the sled from overturning forwardly due to the interaction of the sled being towed and the penetration of the scarifyer into the ocean bottom.

Overlying the collector trough entrance rearwardly of the scarifyer, there is a rotating brush 40. Rotating brush 40 is typically driven by belt mechanisms 41 from the elevator mechanism E.

The function of brush 40 can be readily understood. As sled B is pulled through and along the sediment water interface at the bottom of the sea, the scarifyer will dislodge and cause the accumulation immediately behind its leading edge of mineral particles from the ocean bottom. These particles will be contacted by rotating brush 40, urged downwardly into the arcuate bottom 20 of the collector trough 18.

It will be understood that once the particles are contacted by the scarifyer, classification of the particles from the ambient sediment or ooze on the ocean floor will begin.

As the particles are brushed by rotating brush 40 over slats 34, classification of the particles from the ambient sediment or ocean bottom ooze will occur.

Towing of the sled occurs through two cables 45 attached at runners 14, 16 at points 47 at the upper forward end of the runners with each cable converging upwardly to a towing bridle 46. Towing bridle 46 is in turn connected to the lower end of strip C and is the point at which sled B is towed along the ocean floor. As will hereinafter become more apparent, strip C and buckets D serve together to tow sled B and empty sled B to vessel A as sled B moves along the ocean floor.

Buckets D are conveyed into the interior of trough 18 along a bottom railway 50 on strip C. They then pass between the wheel 55 of elevator mechanism E and strip C on a track 52. These individual buckets D are conveyed on an endless cable 54 in a defined groove 56 on wheel 55 so as to pass around that portion of wheel 55 in contact with endless cable 54. It should be noted that wheel 55 is provided with a rim 58 to hold bucket D securely and radially outward of wheel 55.

It should be appreciated that the buckets pass along arcuate bottom 20 of trough 18 along a tangent with respect to the ocean bottom which is the reverse of the direction in which sled B is towed. Thus, the buckets will not only serve to gather in at their open end 57 particles to be harvested, but will additionally cause the rearward converging movement of the ocean bottom particles at their leading and open end.

Each open ended bucket D will sweep in close proximity to the arcuate bottom 20 of trough 18. Thereafter, the buckets will be conveyed to an overlying track 60 extending between wheel 55 and strip C. Finally, bucket D will be conveyed to the upper surface 62 of strip C at towing bridle 46.

To support both trough 18 and runners 14, 16, as well as conveyor paths 52, 60, a series of cross braces 64, 68 and 70 are provided. These respective cross braces maintain the spatial separation between runners 14, 16 of the sled, hold trough 18 intermediately of the paired sled runners, and additionally furnish the structural support for the bucket paths 52, 60 between wheel 55 and towing bridle 46.

It should be apparent that rotating brush 40 can be powered by an electic motor mounted interiorly of sled B. Preferably, however, wheel 55 is connected to shaft 72 which transpierces sides 22, 23 of trough 18 and extends to drive belt mechanisms 41 to cause rotation to the winnowing brush 40.

It will be remembered that sled B has the additional advantage of forming a central and moving collection point which can be monitored. Accordingly, two television monitors and accompanying lights on standards 82, 84 are shown. Light and camera 82 illuminate the path into which the sled is being towed. The density and configuration of mineral particles about to be harvested in the anticipated path of the sled can be observed.

Camera and light 84 monitor the elevator apparatus interior of the sled. The accumulation of mineral particles can be observed with correspondent adjustments to the towing speed of sled B or the rate of elevator E as it evacuates particles accumulated interior of trough 18 of the collector sled B.

Figure 7:
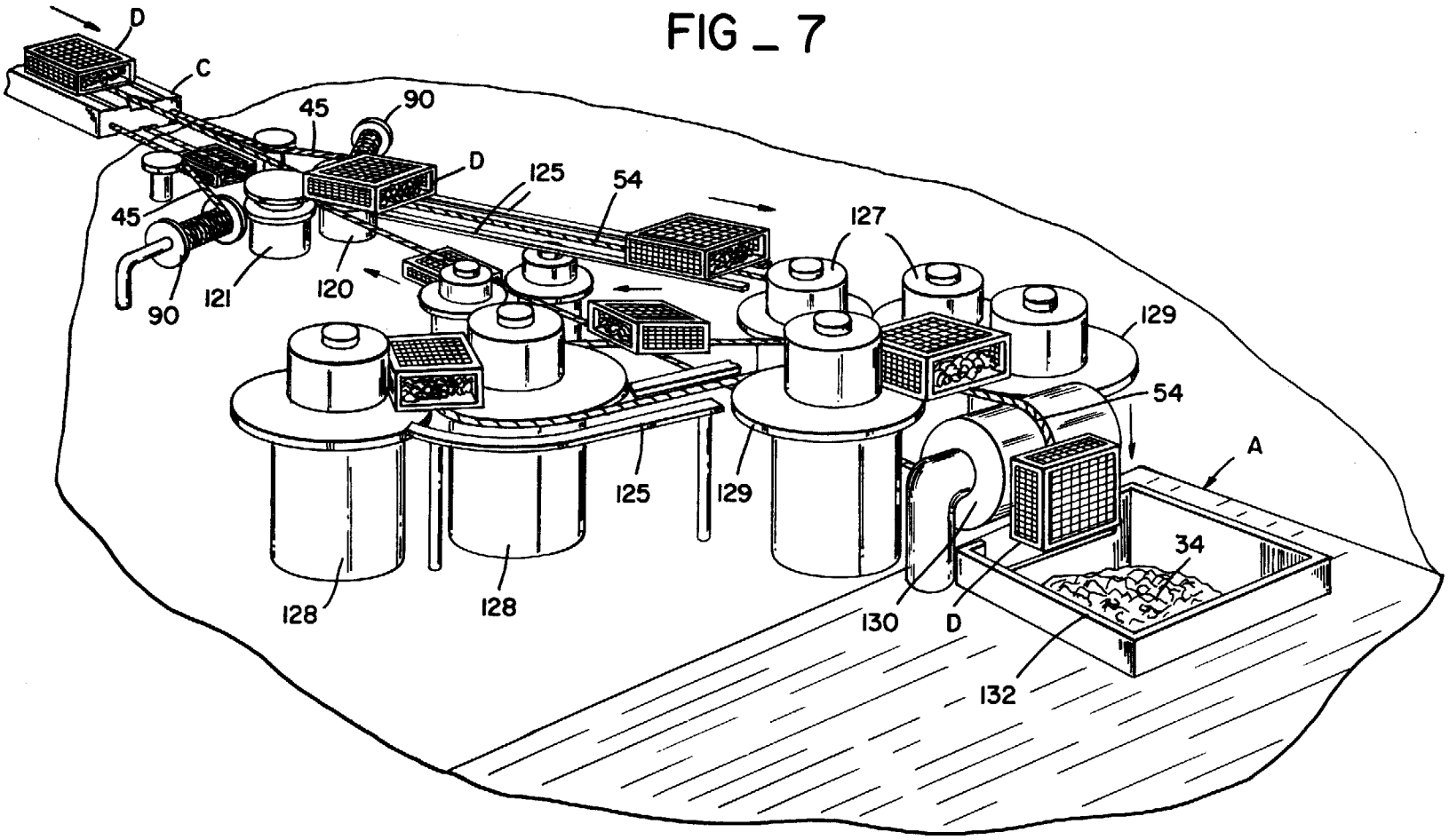

Referring to FIGS. 3 and 4, the construction of the towing strip B can be understood. Typically, cables 45 extend from sled B at the lower end to the fan tail of towing vessel A at the upper end. These cables 45 are reeved at conventional winches 90 on the stern or fan tail of towing vessel A. (See FIG. 7.) Towing cables 45 are typically neutrally buoyant and are preferably constructed of a material having neutral density with respect to sea water. This construction material is known as Kelvar, a registered trademark of E. I. DuPont De Nemours and Company of Wilmington, Delaware.

Intermediate sled B and vessel A, cables 45 are held in spaced apart relation by upper track members 92 and lower track members 93. (See FIGS. 3 and 4.) These respective track members are confronted at respective mating surfaces 94, 95 and cable grooves 96, 97 to hold the spaced apart cables 45 at an equidistant and parallel spacing from sled B on the ocean floor to the fan tail of towing vessel A.

Preferably, track sections 92, 93 are also neutrally buoyant. Thus, as the cable passes from the sled to the vessel, the buoyant force of the sea water essentially supports the weight of towing strip C and its upper and lower tracks 92, 93.

Track sections 92, 93 are of a finite length, preferably being on the order of 6 meters in length each. These track sections at their edges are cross bored at apertures 98 and held across the paired cables 45 by bolts 99. Thus, as cable 45 is played out from conventional winches 90 on the fan tail of towing vessel A, successive sections of track members 92, 93 are fastened to the cable.

Buckets D include an angle frame 100 which is closed by screen 102 at bucket sides and end and is open in the direction of conveyance at an opening 57. As is apparent, when the buckets are conveyed along strip C, water passes through the buckets and through the screen 102 at the sides and end while the harvested particles 34 are captured and thereafter elevated to the surface. Thus, the buckets and the water passing through them can serve to winnow away any remaining sediment 36 from the collected mineral particles 34.

It should be apparent that strip C also forms a convenient conduit for passing protected communication and power cables to sled B. Such communication and power cables are schematically shown at 104.

Figure 5:
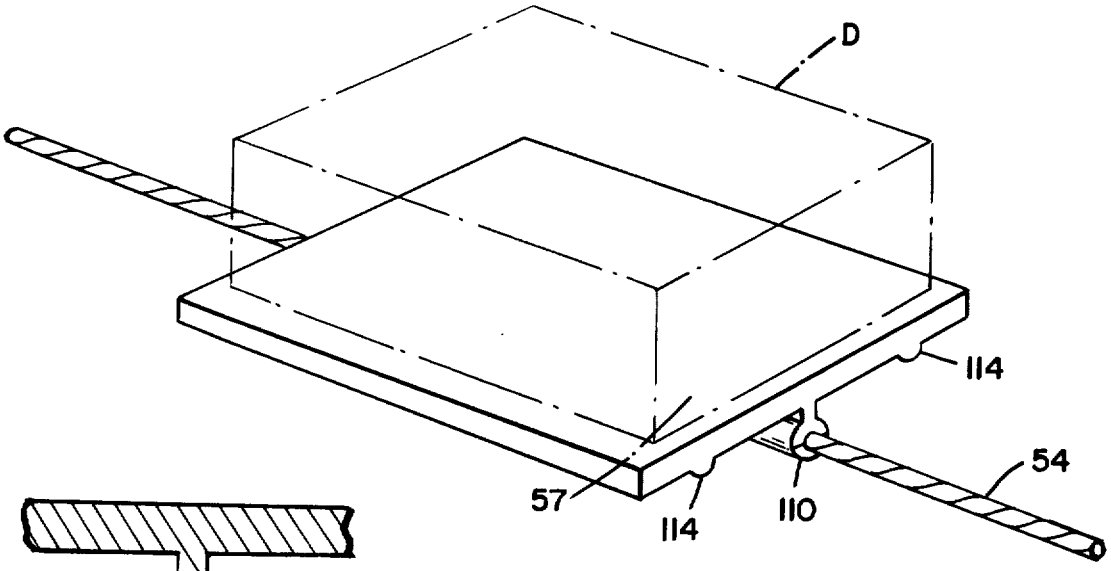
FIG. 5 is a perspective view of the endless belt as well as a partial view of the conveyed bucket apart from the track on which it rides.
Figure 6:
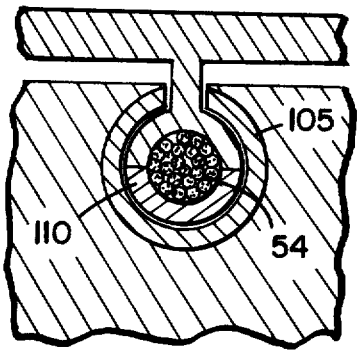
FIG. 6 is a view of the cable and grip for confining the conveyed buckets to a path adjacent the towing strip; and, FIG. 7 is a perspective view of the fan tail of the towing strip illustrating the handling of the towing strip and endless belt conveyed buckets at winches, capstans and drums mounted on the vessel.

Referring to the details of FIGS. 5 and 6, the drawing of the buckets D along towing strip C occurs by means of a traveling endless cable 54 captured interiorly of a cable raceway 105. The individual buckets D are fastened to cable 54 by grips 110 which penetrate interiorly of raceway 105.

It should be noted that the cable grips are captured within the raceway 105. Thus, the grips 110 serve a dual purpose. First, they serve to convey the buckets D upwardly and to the surface of towing vessel A. Secondly, they serve to capture the individual buckets and hold them on the respective railways 92.

Buckets D slide along grooves 112 at runners 114. These runners serve to preserve the alignment of the buckets D as they pass upwardly and downwardly of the towing track C with their respective open ends 57 confronted to the direction of their movement.

Additionally, it shoud be apparent that discrete sections of track 92, 93 are fastened along between cables 45 as they pass from sled B to vessel A. Preferably, these track sections are juxtaposed and are not given the spacing shown in FIG. 3, which spacing is only present for increased understanding of the makeup of towing strip C.

Additionally, it will be apparent that where both the cable raceway 105 and the respective grooves 112 come into contact between adjoining segments of the tracks 92, 93, flaired portions enlarging these respective grooves and raceways are provided. This is done so that the buckets may easily pass from one discrete track segment to an adjoining or adjacent track segment.

Referring to FIG. 6, the handling of the buckets D on the fan tail of towing vessel A is schematically illustrated in a perspective view. Buckets D pass off the surface of the strip C and between idling capstans 120 and 121. These buckets D are kept on top of the endless cable 54 to which they are attached by rail 125, which rails are only partially shown in the perspective view of FIG. 6. The buckets pass around and between three pairs of driving capstans 127, 128, 129. The driving capstans, by winding a section of the endless cable 54 around their periphery and imparting a zigzag configuration to the endless belt 54, provide the power to pull the buckets from the towed sled B to vessel A. Cable 54 passes over an emptying drum 130 and empties the elevated mineral particles 34 into a vessel mounted collection bin 132. The endless belt and its respective buckets D then return to the underside of strip C between idler capstans 120, 121 to the ocean floor.

It should be apparent that the invention herein disclosed will admit of modification. For example, the towing track C and the configuration of both the driving endless belt 54, the cable grip 110 as well as any mechanism which holds buckets D firmly to the track can be altered. Likewise, other modifications of this invention as disclosed herein can occur.

I claim:

1. An elevator apparatus for elevating harvested deepsea particles from an ocean bottom collection point to a surface vessel comprising: a strip extending between said surface vessel and said ocean bottom collection point angularly down to the ocean floor; means for maintaining said strip under tension between said collection point and said surface vessel; said strip including and defining thereon a first and a second railway; a series of sequentially conveyed buckets for movement to said collection point from said vessel along said first railway and movement from said collection point to said vessel along said second railway; means for confining said sequentially conveyed buckets to ride on said first or second railways; means for loading said sequentially conveyed buckets at said collection point; and, means for emptying said sequentially conveyed buckets at said vessel.

2. The invention of claim 1 and wherein said means for maintaining said strip under tension includes means for moving said vessel to place said strip under tension.

3. The invention of claim 1 and wherein said series of sequentially conveyed buckets are mounted to an endless belt, said endless belt having a first belt segment disposed along and confined to said first railway and a second belt segment disposed along and confined to said second railway; and, means on said surface vessel for conveying said belt and attached buckets for movement along said railways.

4. The invention of claim 1 and wherein said strip comprises first and second tension members extending between said surface vessel and said ocean bottom collection point, and said railways comprise track members fastened between said first and second tension members with one side of said track members defining said first railway, and the opposite side of said track members defining said second railway.

5. In the combination of a towing vessel on the surface of the sea, a towed vehicle at the bottom of the ocean, said towed vehicle opening along its towed path for the collection of mineral particles from the ocean bottom along its towed path; a towing strip connected between said vehicle at the lower end and said towing vehicle at the upper end and an elevator for elevating mineral particles from said vehicle to said surface vessel, the improvement in said towing strip and elevator comprising: a strip extending between said surface vessel and said towed vehicle angularly down to the ocean floor, said strip being under tension during towing of said vehicle by said surface vessel; said towing strip including and defining thereon a first and a second railway; a series of sequentially conveyed buckets for movement to said vehicle from said vessel on said first railway and movement from said vehicle to said vessel along said second railway; means for confining said sequentially conveyed buckets to ride on said first or said second railways; means for loading said sequentially conveyed buckets at said vehicle; and, means for emptying said sequentially conveyed buckets at said surface vessel.

6. The combination of claim 5 and wherein said sequentially conveyed buckets are confined to an endless belt and wherein a first length of said endless belt is confined to said first railway, a second length of said endless belt is confined to said second railway; and, means for driving said belt to convey said buckets along said first and second lengths on said railways is mounted on said vessel.

7. The combination of claim 5 and wherein said sequentially conveyed buckets are connected to a belt and said railways each include defined areas for capturing said belts within said railways whereby said buckets are confined to said railways.

8. In the combination of a towing vessel on the surface of the sea, a towed vehicle at the bottom of the ocean for the collection of mineral particles, and means for towing said vehicle extending between said towed vehicle and said towing vessel and an elevator for raising mineral particles from said towed vehicle to the surface vessel, the improvement in said elevator and towing means comprising: at least one towing cable extending between said towed vehicle and said towing vessel; means for defining first and second tracks fastened over said towing cable to define said first track on one side of said cable and said second track on another side of said cable; a series of buckets for movement over said first and second track means; means for confining said buckets to said first and second tracks on said buckets extending to said tracks; and, means for sequentially conveying said buckets from said vessel to said towed vehicle along said first track and for sequentially conveying said buckets from said vehicle to said vessel along said second track.

9. The combination of claim 8 and wherein at least two towing cables extend between said towed vehicle and said towing vessel and wherein said means for defining said first and second track fastens over both said towing cables to maintain said towing cables in parallel spaced apart relation.

10. The combination of claim 8 and wherein a communication conduit extends between said towed vehicle and said towing vessel and said means for said defining said first and second track encompasses and encloses said communication cable between said towed vehicle and said towing vessel.

11. The combination of claim 8 and wherein said means for defining first and second tracks fastened over said towing cable includes at least a first track segment for defining a portion of said first track, a second track segment for defining a portion of said second track, and means for fastening said track segments in back to back relation over said towing cable to encompass and enclose said towing cable.

12. The combination of claim 8 and wherein said means for defining said first and second tracks includes a plurality of track segments placed end to end between said towing vessel and said towed vehicle.

* * * * *